United States Patent [19]

Knoll

[11] Patent Number: 4,677,278

[45] Date of Patent: Jun. 30, 1987

[54] FOOD VENDING MACHINE

[75] Inventor: Hans Knoll, Dettingen, Fed. Rep. of Germany

[73] Assignee: Tepro Präzisionstechnik GmbH, Mönchweiler, Fed. Rep. of Germany

[21] Appl. No.: 877,373

[22] Filed: Jun. 23, 1986

[30] Foreign Application Priority Data

Apr. 24, 1986 [DE] Fed. Rep. of Germany ..... 3613932

[51] Int. Cl.[4] ..... H05B 6/80; G07F 11/54

[52] U.S. Cl. ..... 219/214; 219/388; 219/10.55 R; 219/10.55 D; 99/357; 99/443 R; 221/150 A; 221/150 R

[58] Field of Search ..... 219/10.55 R, 10.55 A, 219/10.55 B, 10.55 D, 214, 388; 99/357, 332, 443 R, 443 C, 355; 221/150 R, 150 A, 150 HC

[56] References Cited

U.S. PATENT DOCUMENTS

| | | | |
|---|---|---|---|
| 3,224,361 | 12/1965 | Öjelid | 99/357 X |
| 3,397,817 | 8/1968 | Smith | 219/10.55 R |
| 3,482,509 | 12/1969 | Gardner | 219/10.55 R |
| 3,943,318 | 3/1976 | Hirai | 219/10.55 D |
| 4,037,070 | 7/1977 | Kirpichnikov et al. | 219/10.55 A |
| 4,398,651 | 8/1983 | Kumpfer | 219/10.55 B X |
| 4,592,485 | 6/1986 | Anderson et al. | 221/150 HC |

FOREIGN PATENT DOCUMENTS 3412899 5/1984 Fed. Rep. of Germany .

*Primary Examiner*—Philip H. Leung
*Attorney, Agent, or Firm*—McAulay, Fields, Fisher, Goldstein & Nissen

[57] ABSTRACT

A food vending machine comprising a store cabinet for a plurality of cooled or non-cooled dishes and a cuboid oven (40). One wall (42) of the oven (40) is provided with an inlet door (46) and another wall (43) is provided with an outlet door (47) for introducing and withdrawing a food dish (28). A first conveying means (49) serves to transfer the dish (28) from the store cabinet through the inlet door (46) into the oven (40). A second conveying means (50) serves to transfer the dish (28) through the outlet door (47) to a dispensing position. Doors (46, 47) adjoin each other over a corner of the oven (40) in order to achieve a simple sequence of motion of the different moving elements, while keeping the construction as compact as possible.

15 Claims, 10 Drawing Figures

FOOD VENDING MACHINE

The present invention relates to a food automat comprising a store cabinet for a plurality of cooled or non-cooled dishes, a cuboid oven having one wall provided with an inlet door and another wall provided with an outlet door for introducing and withdrawing food dishes, and first conveying means for transferring the dishes from the store cabinet through the inlet door into the said oven and second conveying means for transferring the said dishes through the outlet door to a dispensing position.

A food vending machine of this type has been known from German Disclosure Document Number 34 12 899.

The known food vending machine is of modular design. The dispensing cabinet is equipped with all units required for selecting the desired food, and paying for it, and comprises in addition the elements necessary for taking over, heating if necessary and dispensing the food.

In contrast, a store cabinet is provided which is intended merely for storing the food, in particular cooled or frozen food. Once a given quantity of food has been removed from it, it can be exchanged against a new filled store cabinet without the necessity to move the dispensing cabinet for this purpose.

In the case of the known food vending machine, the two adjacent side walls of the store cabinet and dispensing cabinet, respectively, are provided with an oblong opening extending in the vertical direction over almost the full height of the cabinets. The opening in the side wall of the dispensing cabinet is open, while the opening in the store cabinet is provided with a shutter-like slide ensuring the thermal insulation of the store cabinet from the dispensing cabinet. The shutter slide is provided with a single transfer opening at a given vertical position which can be moved vertically together with the shutter slide to permit a food dish from any level of the store cabinet to be transferred into the dispensing cabinet.

This function is performed by a transport slide which is arranged preferably in the dispensing cabinet where it can be displaced in at least two directions. On the one hand, the transport slide can be displaced vertically so that each level at which dishes are stored in the store cabinet can be selected; on the other hand, it can, however, also be moved laterally through the transfer opening into the store cabinet for the purpose of withdrawing a food dish from the store cabinet and transferring it into the dispensing cabinet.

The transport slide transfers the selected dish in the dispensing cabinet initially into a pre-determined vertical level in which the food dish is moved laterally into a transfer position. In the case of the known food automat, the food dish is then moved by a conveyor belt in a forward direction into a continuous microwave oven which is provided for this purpose with front and rear hinged doors. After a short dwelling period in the microwave oven, during which the food is heated up in a suitable manner, the dish is then carried by the conveyor belt in a forward direction, out of the oven and then on to an inclined chute along which the dish slides into a dispensing position defined by a front stop. In the known food vending machine, the dispensing position is always open to the outside.

The known food vending machine therefore requires a relatively complex mechanical system for synchronizing the different motions necessary for transporting the food from the store cabinet, through the oven and to the dispensing position. In particular, the movement of the doors of the oven must be coordinated in such a manner that they always open just at the moment when the food dish is to be moved into or out of the oven because very serious operating trouble could occur if the dish either got stuck before the closed inlet door of the oven or if the closed outlet door prevented its timely withdrawal from the oven.

Another disadvantage of the known food vending machine is seen in the fact that due to the inhomogeneities of the distribution of heat within the oven, the food is also heated up inhomogeneously so that in the event frozen food is used as a starting material it may happen in extreme cases that the food when served has been heated only in part, while the other part is still cold or even frozen.

Another disadvantage of the known device resides in the fact that the conveyor means for transporting the food dishes into and out of the oven are relatively complex in design and, therefore, a source of possible operating trouble. However, the susceptibility to trouble is a point of extreme importance for the food vending machines according to the invention because the latter are frequently used heavily during "rush hours", for example at lunch time in factories where it is important that all users get their meals without any waiting times.

Finally, it is a disadvantage of the known food vending machines that access to the oven inside the food vending machines is relatively difficult so that extended shutdown periods are encountered in the case of repair or maintenance work.

Now, it is the object of the present invention to improve a food vending machine of the type described above in such a manner that the before-mentioned disadvantages are avoided and, in particular, that the sequence of motions in the area of the oven is simplified with a minimum of space required.

This object is achieved according to the invention by an arrangement in which the walls adjoin each other over a corner of the oven.

The object underlying the present invention is completely solved in this manner because the food dishes are transported through the oven along a path which is bent off by 90° so that a minimum of space is required only while at the same time the compact arrangement permits the sequence of motions to be coordinated in a particularly simple manner.

According to a preferred embodiment of the invention, the doors are designed as an angular part extending over the corner and forming the doors.

This feature provides the advantage that both doors can be opened and closed, respectively, by a simple linear movement and a single actuating unit. Hence, any problems of coordination between the opening motion of the two doors are positively excluded.

According to a further improvement of the invention, a rotary plate is arranged in the oven on which the food dishes can be positioned by the first conveyor means and from which they can be removed by the second conveyor means.

This feature provides the advantage that any inhomogeneities of the distribution of heat in the oven are compensated by rotating the food dish so that all areas of the food are passed through the possibly different heat zones. If a microwave oven is used, rotating the food dishes provides the additional advantage that the field distribution of the microwaves in the oven is continuously varied so that no zones of very different heat development can occur.

In a preferred further improvement of this embodiment, the rotary plate is provided with radial recesses for receiving telescopic holders of the said first conveyor means.

This feature provides the advantage that the food dishes can be moved into and removed from the microwave oven by extremely simple conveyor means because during charging of the oven, for example, the telescopic holders carrying the food dish that has been taken from the store cabinet can move into the radial recesses of the rotary plate and then be lowered to a position the food dish on the rotary plate. After retraction of the telescopic holder, the food dish can then be rotated on the rotary plate and, after heating, be pushed out of the oven in any desired angular position.

According to one preferred embodiment of the invention, the second conveyor means consists of a motor-driven motor vehicle antenna.

The advantage of this feature lies in the fact that motor-driven motor vehicle antennas are low-priced mass products which permit in a reliable manner a defined axial movement to be initiated by electric control signals. In addition, the force of the drive motors used in such antennas is absolutely sufficient not only to overcome the frictional resistance in the telescope of the antenna as such, but also to provide in addition a linearly directed force sufficiently important to displace a food dish of the size relevant in this context.

According to another embodiment of the invention, the oven can be displaced and withdrawn through an opening in a wall of the food automat.

This feature provides the advantage that the oven can be removed without any difficulties from the housing of the food vending machine, even by unskilled personnel, for thorough cleaning either at regular intervals or as needed. As a side effect this also improves the service properties of the food automat because the oven can of course be removed in the same manner also for repair purposes.

In a particularly preferred variant of this embodiment, the oven is placed on rollers.

It is an advantage of this feature that the oven can be withdrawn from the housing with particular ease, but of course sliding or other guides of any conventional type are likewise suited for this purpose.

According to a still other variant of this embodiment of the invention, the oven can be displaced in a first direction, transverse to a second direction in which the dishes are dispensed from the oven.

This feature is of advantage in the case of a food vending machine in which the food is transported into the oven from the rear or from one side and dispensed from the oven at its front, because then the units required for transporting the dishes into and out of the oven are not in the way when removing the oven from the housing.

Further advantages of the invention will appear from the following description and the attached drawing.

It goes without saying that the features which have been described above and which will be explained further below can be used not only in the described combination, but also in any other combination or individually, without leaving the scope of the present invention.

Certain embodiments of the present invention will be described in greater detail in the following specification with reference to the drawing in which.

Figure 2:
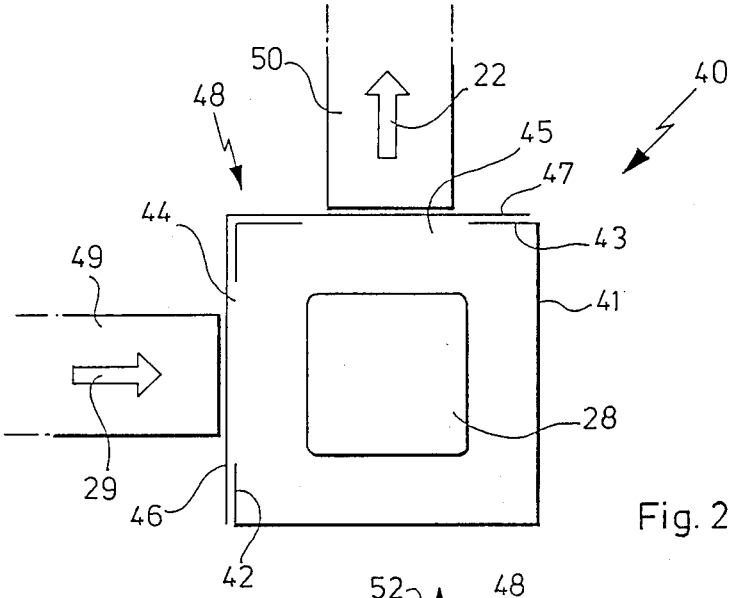
FIG. 2 shows an embodiment of an oven suited for use in a food vending machine according to the invention.
Figure 3:
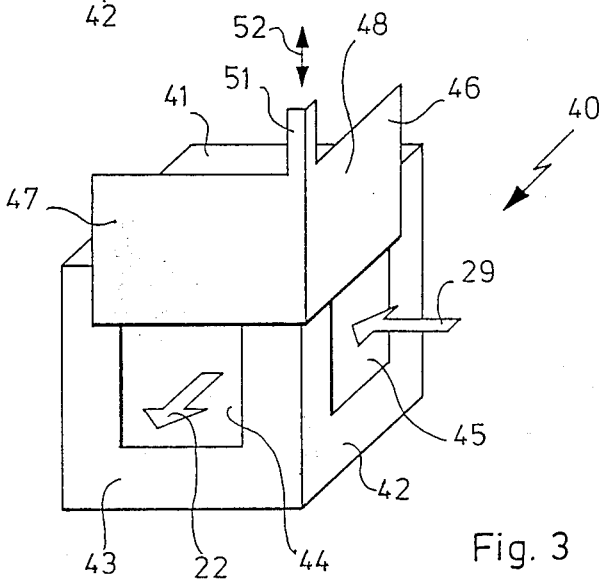
FIG. 3 shows a perspective view of the embodiment illustrated in FIG. 2.
Figure 4A:
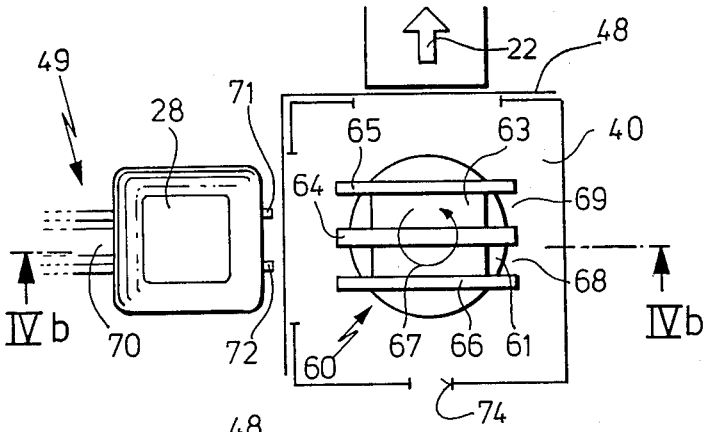
Figure 4B:
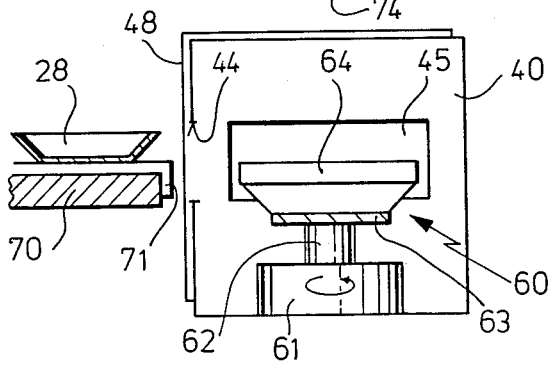
Figure 5:
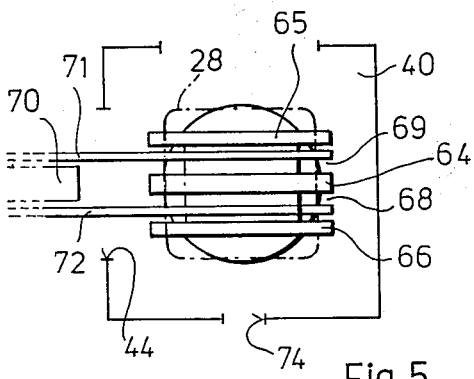
Figure 6:
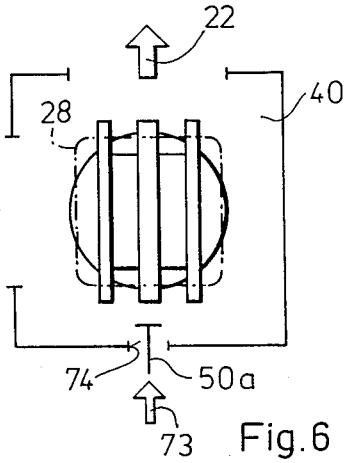
Figure 7:
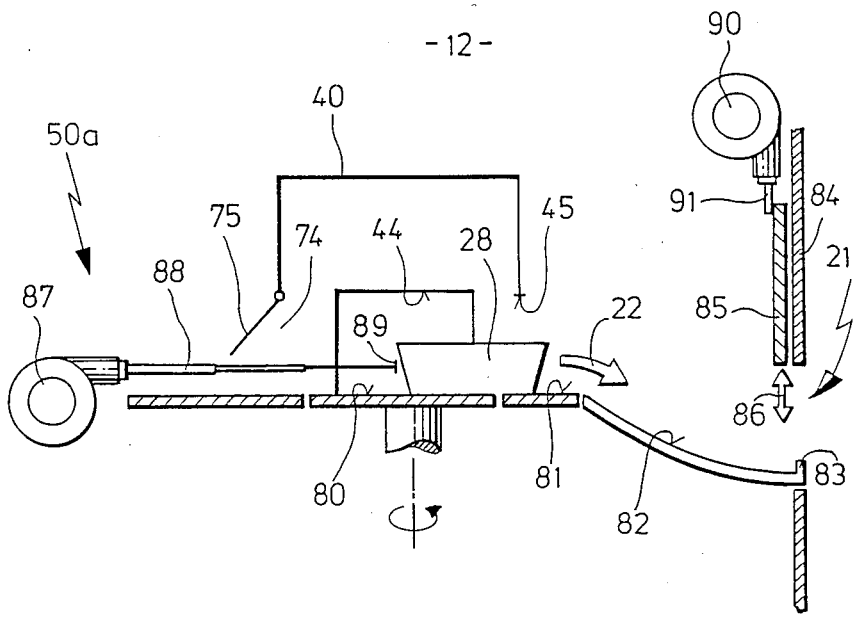
Figure 8:
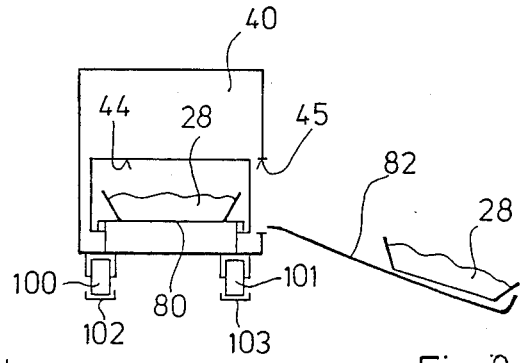
Figure 9:
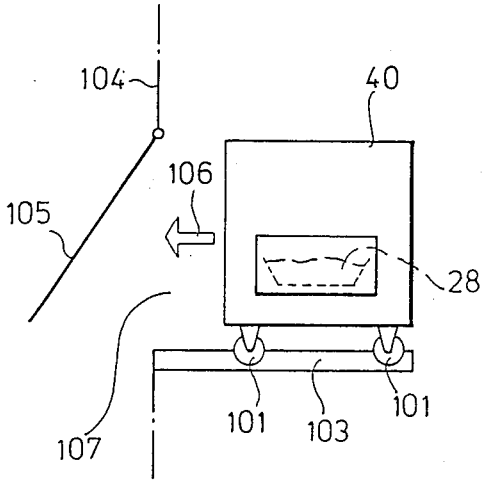

FIGS. 4*a* and 4*b* show a top view and a side view of the oven according to FIGS. 2 and 3, for further illustration of certain embodiments;

FIG. 5 shows a view similar to that of FIG. 4*a*, illustrating the transfer system used;

FIG. 6 shows a view similar to that of FIG. 5, illustrating however another transfer system;

FIG. 7 shows a diagrammatic side view, partly in cross-section, of the interior of a dispensing cabinet, for illustrating one embodiment of the transfer system shown in FIG. 6;

FIG. 8 shows a cross-section through another embodiment of an oven in a food automat, viewed from the side;

FIG. 9 shows a front view of the embodiment represented in FIG. 8.

Figure 1:
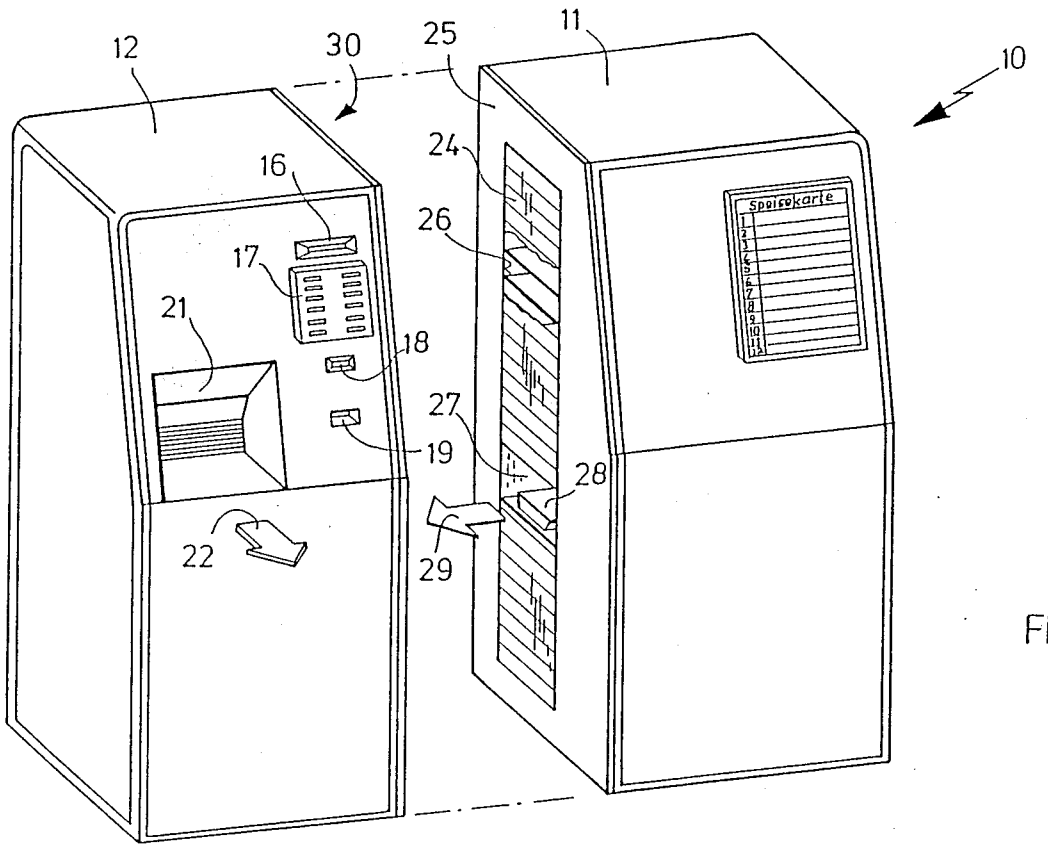
FIG. 1 shows a perspective overall view of a food vending machine according to the invention.

In FIG. 1, reference numeral 10 designates a food vending machine consisting of a store cabinet 11 and a dispensing cabinet 12, the two cabinets being shown in FIG. 1 in a position apart from each other.

The store cabinet 11 is provided with a selector station which contains a list of the dishes contained in the store cabinet 11 and, if necessary, the required switching elements, such as selector keys or the like, to permit the user of the food automat 10 to select the dishes desired by him.

The dispensing cabinet 12 is equipped with a price display 16 for indicating the money amount which the user has to pay. A numerical display 17 indicates once more the dishes that have been selected by the user and which are being prepared. Now, coins or a credit card, or the like, may be inserted into the food vending machine through a coin slot 18 or a card slot 19 in payment of the food.

The food which is stored in the store cabinet 11 preferably at deep-freezing temperatures, is transferred into the dispensing cabinet 12, where it is heated, if necessary, in a microwave oven and then handed out to the user in the direction indicated by arrow 22 via a dispensing chute 21.

It can be further seen in FIG. 1 that the side of the store cabinet 11 facing the dispensing cabinet 12 is provided with an opening 26 which is convered by a shutter-like slide 24 and is completely closed, except for a transfer opening 27. The transfer opening 27, which can be displaced vertically, serves to select the one level of the store cabinet 11 from which the dish 28 is to be transferred later in the direction indicated by arrow 29 into the dispensing cabinet 12. The side wall 30 of the dispensing cabinet 12 opposite the side wall 25 of the store cabinet 11 is provided for this purpose with an opening matching the opening 26.

In FIGS. 2 and 3 the oven 40, which may for example be a microwave oven, has an approximately cuboid housing 41. A first side wall 42 is adjoined at one corner by a second wall 43. An inlet opening 44 and an outlet opening 45 are arranged in the walls 42, 43. The inlet opening 44 can be closed and opened, respectively, by a first door 46. The outlet opening 45 is provided analogously with a second door 47. The two doors 46, 47 are formed integrally as a single angular part 48.

In the open operating condition shown in FIG. 3, a first transfer system 49 can move a food dish 28 in the direction of arrow 29 into the oven 40, through a charging opening 44.

After the food dish 28 has been moved into the position in the oven 40 shown in FIG. 2, the doors 46, 47 close jointly in downward direction—as viewed in FIG. 3—and the oven 40 is now ready for being heated. After the food in the food dish 28 has been heated up to the pre-determined temperature, the doors 46, 47 are again moved upwardly—in the representation of FIG. 3—and the food dish 28 can be discharged from the oven 40 by a second transfer system 50 in the direction indicated by arrow 22 through the discharge opening 45.

FIG. 3 shows by way of example that the angular part 48 is provided in the area of the common edge of the doors 46, 47 with an extension in the form of an angle 51 which may be acted upon by conventional magnetic or pneumatic or electromagnetic actuating means in order to move the angular part 48 up or down in the directions indicated by double arrow 52 in FIG. 3.

FIGS. 4*a* and 4*b* shown once more a top view and a side view, respectively, of the cuboid oven 40 in the open condition. It can be seen that a rotary plate 60 is arranged inside the oven 40 and mounted on a vertical rotary drive 61 for being rotated about its vertical axis. To this end, a vertical shaft 62 carries on its upper end a connecting piece 63 from which project, in comb-like manner, a central web 64 and, arranged laterally at a distance therefrom and parallel thereto, two lateral webs 65 and 66. As a result of this arrangement, radial recesses 68, 69 are formed between the said webs 64, 65 and 66. The shaft 62, together with the connecting piece 63 and the webs 64, 65, 66 revolve about a vertical axis, as indicated by arrow 67.

The first transfer means 49 is equipped with a slide comprising a substantially stationary stator 70 and two telescopic holders 71, 72. The holders 71, 72 run, preferably, immediately beside the stator 70 and may take the form of telescopic slides of the type known, for example, from drawers. The upsides of the holders 71, 72 project a little beyond the upside of the stator 70. A food dish 28 placed upon the telescopic holders 71, 72 may, therefore, be displaced on the holders 71, 72 relative to the stator 70.

FIG. 5 illustrates the situation in which a food dish 28 is moved into the oven 40 by means of first conveyor means 49. After the angle part 48 has been lifted off as shown in FIG. 3, the holders 71, 72 with the food dish 28 placed thereon can enter the inside of the oven 40 through the charging opening 44. During this motion, the holders 71, 72 run along the recesses 68, 69 between the webs 64, 65, 66. It goes without saying that when moving the food dish 28 into the oven 40, the height of the first conveyor means 49 has to be adjusted to ensure that the bottom of the food dish 28 is located at a distance above the upper edges of the webs 64, 65, 66.

Once the food dish 28 has reached the position shown in broken lines in FIG. 5, the first conveyor means 49 is lowered a little so that the food dish 28 gets into contact with the upsides of the webs 64, 65, 66, whereupon the holders 71, 72 can be retracted towards the stator 70.

Now, the angle part 48, together with the doors 46, 47 are lowered and the oven 40 is switched on. During the heating process, the rotary plate 60 is set to rotate so that any remaining inhomogeneities of heat distribution are averaged out.

After sufficient heating of the food, the rotary plate 60 is moved into the position shown in FIG. 6 in which the food dish 28 occupies a position turned by 90° relative to the charging position shown in FIG. 5.

An opening 64 in the rear part of the housing of the oven 40 now permits a second transfer means 50*a* to enter the oven in the direction indicated by arrow 73 and to push the food dish 28 forwardly in the direction of arrow 22 and out of the oven 40, as illustrated by way of example in FIG. 7.

In FIG. 7, the charging opening 44 can be seen through which the food dish 28 has been moved in a manner not shown in FIG. 7 into a heating position 80 in the oven 40, as has just been described by way of example with reference to FIGS. 4 to 6. After heating, the food dish 28 is moved by the second transfer means 50*a* through the discharge opening 45 of the oven 40 to a forward end 81.

From the said forward end 81, the food dish 28 moves in the direction indicated by arrow 22 towards a dispensing position 82 designed as a chute and limited at its forward end by a stop 83.

The stop 83 preferably is arranged flush with a front wall 84 of the dispensing cabinet 12, and the opening of the dispensing chute 21 thus formed can be closed by means of a sliding door 85 that can be moved up and down in the direction indicated by double arrow 86.

For the purpose of moving the food dish 28 from the heating position 80 to the front end 81, a first motor-driven motor vehicle antenna 87 is arranged at the end opposite the said forward end 81. The alignment and dimensions of the said antenna are selected in such a manner that its telescope 81 can sweep substantially the whole length of the bottom of the oven 40 in the direction of movement of the food dish 28.

In this manner, it is possible to push a food dish 28 with the aid of the first motor-driven motor vehicle antenna 87 from the heating position 80 into the dispensing position 42, through the opening 74 in the oven 40 which can be closed by means of the flap 75. The latter is, conveniently, closed during heating of the food.

The first motor-driven motor vehicle antenna 87 can be operated in a simple manner by electric control signals in order to obtain the before-described motion sequence.

A second motor-driven motor vehicle antenna 90 is provided for moving the sliding door 85 vertically in the direction indicated by the double arrow 86. This second antenna 90 is arranged on the inside of the front wall 84, and its telescope 91 is connected with the sliding door 85 so that the sliding door 85 can be displaced in the direction indicated by double arrow 86, likewise with the aid of simple electric control signals.

For the purpose of sensing the different desired positions or end positions of the telescopes 88 and/or 91, conventional position or limit switches of the type already contained as standard in certain motor-driven motor vehicle antennas can be used, which then switch the antenna drive off when a pre-determined end position has been reached.

In the case of the embodiment shown in FIGS. 8 and 9, the bottom of the oven 40 is provided with rollers 100, 101 running in rails 102, 103, to make the oven 40 easily removable from the food vending machine 10.

As can be seen particularly clearly in FIG. 9, the rails 102, 103 are arranged in a direction perpendicular to the conveying direction of the food dish 28.

A hinged door 105 provided in a wall 104 of the food vending machine 10 closes an opening 107 in the wall 104. In FIG. 9, it can be seen that the rollers 100, 101 and the rails 102, 103 permit the oven 40 to be withdrawn from the food vending machine 10 through the opening 107, in the direction indicated by arrow 106.

Of course, a great number of still other variants are also imaginable within the scope of the present invention. For example, a sliding guide may be provided instead of the rollers 100, 101 and the rails 102, 103. The direction of movement of the oven 40 has been selected of course only with a view to the particular embodiment described, and the oven 40 may as well be removed from the food vending machine 10 in any other direction, even from above. The exact direction of movement of the oven 40 and the means by which the oven is displaced most conveniently depend of course on the conveying direction of the food dish 28 and on where the units that could obstruct the movement of the oven 40 are arranged inside the food vending machine 10.

I claim:

1. A food vending machine comprising a store cabinet for storing a plurality of cooled or non-cooled food-dishes;

a cuboid oven for heating said food-dishes;

said cuboid oven having an inlet aperture in a first side wall for introducing said food-dishes to be heated into said cuboid oven;

said cuboid oven having further an outlet aperture in a second side wall adjoining said first side wall over a corner of said cuboid oven for withdrawing said food dishes after being heated from said cuboid oven;

first conveying means for transferring said food-dishes from said store cabinet through said inlet aperture into said cuboid oven;

second conveying means for transferring said heated food-dishes from said cuboid oven through said outlet aperture into a dispensing position; and a first door and a second door for closing said inlet and outlet apertures, respectively, said first and second doors being formed integrally as a single L-shaped device extending over said corner of said cuboid oven and covering said inlet and outlet apertures in a first position; actuating means for displacing said L-shaped device in a vertical direction for commonly closing said inlet and outlet apertures in said first vertical position and for commonly rendering open said inlet and outlet apertures in a second vertical position.

2. The food vending machine of claim 1, wherein a rotary plate is arranged in said cuboid oven on which said food-dishes can be positioned by said first conveying means and from which said food-dishes can be removed by said second conveying means.

3. The food vending machine of claim 2, wherein said rotary plate is provided with radial recesses for receiving telescopic holders of said first conveying means.

4. The food vending machine of claim 1, wherein said second conveying means are provided with a motor-driven motor vehicle antenna, said antenna being arranged outside a third side wall, opposite said second side wall, said antenna having a telescope penetrating through a further aperture in said third side wall to push said heated food-dish upon actuating of said motor drive from said cuboid oven through said outlet aperture into said dispensing position.

5. The food vending machine of claim 1, wherein said oven can be displaced and withdrawn through an opening in a wall of said food vending machine.

6. The food vending machine of claim 5, wherein said oven is placed on rollers.

7. The food vending machine of claim 5, wherein said oven can be displaced in a first direction, perpendicular to a second direction in which said food-dishes are transferred into said dispensing position.

8. A food vending machine, comprising:

a store cabinet for storing a plurality of food dishes having different temperatures;

a cuboid oven for heating the food dishes;

said cuboid oven having in a first side wall thereof an inlet doorway for introducing the food dishes to be heated into said cuboid oven;

said cuboid oven having in a second side wall thereof an outlet doorway for withdrawing said food dishes after being heated in said cuboid oven, said second side wall adjoining said first side wall;

orthogonally related conveyor means for transferring the food dishes from said store cabinet through said inlet door into said cuboid oven and for transferring the heated food dishes from said cuboid oven through said outlet door into a dispensing position;

first and second doors for closing said first and second doorways, respectively, said first and second doors being formed integrally as a single L-shaped device extending over said corner of said cuboid oven and covering said inlet and outlet doorways in a first position; and actuating means for displacing said L-shaped device in a vertical direction for commonly closing said inlet and outlet doorways in said first vertical position and for commonly rendering open said inlet and outlet doorways in a second vertical position.

9. The food vending machine of claim 8, wherein said orthogonally related conveyor means includes a first conveyor for transferring the food dishes into said cabinet and a second conveyor displaced 90° from said first conveyor for removing the food dishes from said cabinet.

10. The food vending machine of claim 9, including means associated with said oven for displacement thereof in a first direction, perpendicular to a second direction in which said food dishes are transferred into said dispensing position.

11. The food vending machine of claim 8, including a rotary plate arranged in said cuboid oven proximate to said conveyor means for positioning the food dishes thereon and for removing the food dishes.

12. The food vending machine of claim 8, including means for displacing and withdrawing the oven from said food vending machine.

13. The food vending machine of claim 12, including rollers for said oven and rails with which said rollers cooperate to facilitate removal of said oven from said food vending machine.

14. The food vending machine of claim 8, wherein said cabinet stores cold dishes relative to the ambient temperature.

15. The food vending machine of claim 8, wherein said cabinet stores dishes having a temperature higher than the ambient temperature.

* * * * *